US010249226B2

(12) United States Patent
Kim et al.

(10) Patent No.: US 10,249,226 B2
(45) Date of Patent: Apr. 2, 2019

(54) DISPLAY DEVICE AND METHOD OF TUNING A DRIVER

(71) Applicant: SAMSUNG DISPLAY CO., LTD., Yongin-si, Gyeonggi-do (KR)

(72) Inventors: Sooyeon Kim, Seoul (KR); Wontae Kim, Cheongju-si (KR); Young-Il Ban, Hwaseong-si (KR); Sunkyu Son, Suwon-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 97 days.

(21) Appl. No.: 15/146,952

(22) Filed: May 5, 2016

(65) Prior Publication Data

US 2016/0343342 A1 Nov. 24, 2016

(30) Foreign Application Priority Data

May 22, 2015 (KR) ..... 10-2015-0072073

(51) Int. Cl.
*G09G 3/20* (2006.01)

(52) U.S. Cl.
CPC ..... *G09G 3/20* (2013.01); *G09G 2330/06* (2013.01); *G09G 2370/08* (2013.01)

(58) Field of Classification Search
CPC ... G09G 3/20; G09G 2330/06; G09G 2370/08
See application file for complete search history.

(56) References Cited

U.S. PATENT DOCUMENTS 5,245,630 A * 9/1993 Ainsworth ..... G01R 35/005 324/616
5,644,417 A * 7/1997 Aulet ..... H04B 10/07 398/32
5,978,742 A * 11/1999 Pickerd ..... G01R 13/0272 324/121 R
6,697,750 B1 * 2/2004 Coin ..... H04B 10/07 702/106
6,785,622 B2 8/2004 Nygaard, Jr.
7,698,669 B1 * 4/2010 Chow ..... H04L 1/20 324/436
8,184,747 B2 * 5/2012 Baker ..... G01R 13/0254 375/224

(Continued)

FOREIGN PATENT DOCUMENTS

JP 2007053648 3/2007
JP 2007286025 11/2007

(Continued)

*Primary Examiner* — Nitin Patel
*Assistant Examiner* — Robert M Stone
(74) *Attorney, Agent, or Firm* — F. Chau & Associates, LLC

(57) ABSTRACT

A driving method of a display device includes sequentially outputting a plurality of eye tuning signals, receiving a plurality of checking information obtained from a data driving circuit, wherein the checking information indicates whether the data driving circuit is operating in response to each of the plurality of eye tuning signals, and selecting one optimal eye tuning signal among the plurality of eye tuning signals operating the data driving circuit on the basis of the checking information. Image signals are output on the basis of condition information of the optimal eye tuning signal.

15 Claims, 7 Drawing Sheets

(56) References Cited

U.S. PATENT DOCUMENTS

| | | | | |
|---|---|---|---|---|
| 2003/0083833 | A1* | 5/2003 | Nygaard, Jr. | H04L 1/24 702/67 |
| 2005/0271087 | A1* | 12/2005 | Amagai | G01R 13/32 370/516 |
| 2006/0031031 | A1* | 2/2006 | Cohn | G01R 13/0254 702/66 |
| 2007/0156360 | A1* | 7/2007 | Romero | G01R 31/31709 702/69 |
| 2009/0195525 | A1* | 8/2009 | Karapattu | G01R 31/31709 345/208 |
| 2010/0039156 | A1* | 2/2010 | Yamaguchi | G09G 3/2096 327/291 |
| 2010/0207930 | A1* | 8/2010 | Chung | G09G 3/3611 345/214 |
| 2013/0021306 | A1* | 1/2013 | Kuo | G09G 3/20 345/204 |
| 2015/0319020 | A1* | 11/2015 | Song | H04L 25/03 345/204 |

FOREIGN PATENT DOCUMENTS

| | | |
|---|---|---|
| JP | 2009085748 | 4/2009 |
| KR | 1020070077741 | 7/2007 |
| KR | 1020140102391 | 8/2014 |

* cited by examiner

FIG. 6

| Eye Tuning Signal (QS) | First Condition (I1) | Second Condition (I2) | First Checking Information | Second Checking Information | Third Checking Information |
|---|---|---|---|---|---|
| QS1 | I1_1 | I2_1 | OFF | OFF | OFF |
| QS2 | I1_1 | I2_2 | OFF | ON | OFF |
| QS3 | I1_1 | I2_3 | OFF | ON | OFF |
| QS4 | I1_1 | I2_4 | ON | ON | OFF |
| QS5 | I1_2 | I2_1 | ON | OFF | ON |
| QS6 | I1_2 | I2_2 | ON | OFF | ON |
| QS7 | I1_2 | I2_3 | OFF | OFF | ON |
| QS8 | I1_2 | I2_4 | OFF | OFF | OFF |

FIG. 7

| Data driving circuit | Eye tuning signal (QS) |
|---|---|
| First data driving circuit | QS5 |
| Second data driving circuit | QS3 |
| Third data driving circuit | QS6 |

DISPLAY DEVICE AND METHOD OF TUNING A DRIVER

CROSS-REFERENCE TO RELATED APPLICATION

This application claims priority under 35 U.S.C. § 119 to Korean Patent Application No. 10-2015-0072073, filed on May 22, 2015, the disclosure of which is hereby incorporated by reference in its entirety.

TECHNICAL FIELD

The present disclosure relates to a display device and a method of driving the display device and more particularly to a method and device for tuning the signals used to drive a display device.

DISCUSSION OF RELATED ART

A display device includes gate lines, data lines, and pixels connected to the gate lines and the data lines. The display device includes a gate driver applying gate signals to the gate lines and a data driver applying data signals to the data lines.

The display device includes a signal controller controlling the gate driver and the data driver. The signal controller provides image signals to the data driver. The data driver applies the image signals to the pixels.

As display device becomes larger in size and higher in resolution, the size of the image signals transmitted between the signal controller and the data driver has increased. As a result, a high-speed channel between the signal controller and the data driver is used. This high-speed channel is susceptible to electromagnetic interference from a variety of sources.

SUMMARY

The present disclosure provides a display device capable of preventing image signals applied to a data driver from being distorted.

The present disclosure provides a method of driving the display device.

According to an exemplary embodiment of the inventive concept provide a driving method of a display device, including sequentially outputting a plurality of eye tuning signals, receiving a plurality of checking information obtained from a data driving circuit, wherein the checking information indicates whether the data driving circuit is operating in response to each of the plurality of eye tuning signals, and selecting one optimal eye tuning signal from among the plurality of eye tuning signals operating the data driving circuit based on the checking information. Image signals are output based on the condition information of the optimal eye tuning signal.

In an exemplary embodiment of the present disclosure, each of the eye tuning signals is set by at least one different condition.

In an exemplary embodiment of the present disclosure, the selecting of the optimal eye tuning signal includes selecting one eye tuning signal having an intermediate value among three or more odd-number eye tuning signals that are consecutive, which operate the data driving circuit.

In an exemplary embodiment of the present disclosure, the selecting of the one optimal eye tuning signal includes selecting one eye tuning signal of a first eye tuning signal and a second eye tuning signal closest to an intermediate value among two or more even-number eye tuning signals that are consecutive, which operate the data driving circuit.

In an exemplary embodiment of the present disclosure, the method further includes changing a signal-to-noise ratio of the eye tuning signals, and the operation of the data driving circuit is checked in response to each of the eye tuning signals in which the signal-to-noise ratio is changed.

In an exemplary embodiment of the present disclosure, the data driving circuit is provided in a plural number and each of the data driving circuits outputs the image signals based on the condition information of the optimal eye tuning signal among the eye tuning signals.

In an exemplary embodiment of the present disclosure, the method further includes storing the condition information of the optimal eye tuning signal corresponding to each of the data driving circuit in a memory.

According to an exemplary embodiment of the present disclosure, the inventive concept provides a display device including a data driving circuit and a signal controller. The data driving circuit that generates a plurality of checking information by determining whether the data driving circuit is operating in response to each of a plurality of eye tuning signals and that transmits the plurality of checking information to the signal controller. The signal controller that sequentially outputs a plurality of eye tuning signals and that receives a plurality of checking information. The signal controller selects one optimal eye tuning signal among the plurality of eye tuning signals operating the data driving circuit based on the checking information and outputs a plurality of image signals to the data driving circuit based on the condition information of the optimal eye tuning signal.

In an exemplary embodiment of the present disclosure, the data driving circuit controls a signal-to-noise ratio of the eye tuning signals to generate a plurality of noise signals.

In an exemplary embodiment of the present disclosure, a signal-to-noise ratio of the noise signals is smaller than the signal-to-noise ratio of the eye tuning signals.

In an exemplary embodiment of the present disclosure, the data driving circuit includes an operation checker that checks whether the data driving circuit is operated in response to each of the noise signals, and the operation checker applies the checking information obtained by checking whether the data driving circuit is operated in response to each of the noise signals to the signal controller.

In an exemplary embodiment of the present disclosure, each of the eye tuning signals is differentiated by at least one condition.

In an exemplary embodiment of the present disclosure, the data driving circuit includes a plurality of data driving circuits and the signal controller outputs the image signals to each of the data driving circuits based on the condition information of the optimal eye tuning signal for each data driving circuit.

In an exemplary embodiment of the present disclosure, the display device further includes a memory for storing the condition information of the optimal eye tuning signal.

In an exemplary embodiment of the present disclosure, the memory is a nonvolatile memory.

According to an exemplary embodiment of the present disclosure, the inventive concept provide a driving method of a display device including receiving a plurality of eye tuning signals and modifying the plurality of eye tuning signals. A data driving circuit is checked to determine if it is operating in response to each of the plurality of eye tuning signals, generating a checking information based on the checking and transmitting the checking information to a signal controller. Image signals based on condition information of a selected eye tuning signal from a plurality of eye tuning signals are received. The one eye tuning signal is selected based on the checking information.

In an exemplary embodiment of the present disclosure, the method further includes changing a signal-to-noise ratio of the eye tuning signals to improve the signal quality.

In an exemplary embodiment of the present disclosure, the checking of whether a data driving circuit is operating in response to each of the plurality of eye tuning signals includes determining if the data driving circuit is operating in response to each eye tuning signal of the plurality of eye tuning signals received.

In an exemplary embodiment of the present disclosure, the selecting of the eye tuning signal includes selecting one eye tuning signal having an intermediate value among three or more odd-number eye tuning signals that are consecutive.

In an exemplary embodiment of the present disclosure, the selecting of the eye tuning signal includes selecting one eye tuning signal of first and second eye tuning signals closest to an intermediate value among two or more even-number eye tuning signals that are consecutive.

BRIEF DESCRIPTION OF THE DRAWINGS

The above and other aspects of the present disclosure will become readily apparent by reference to the following detailed description when considered in conjunction with the accompanying drawings wherein:

FIG. 6 is a table showing results of the eye tuning operation according to an exemplary embodiment of the present invention.

FIG. 7 is a table showing results of the eye tuning operation according to an exemplary embodiment of the present invention.

DETAILED DESCRIPTION

It will be understood that when an element or layer is referred to as being "on", "connected to" or "coupled to" another element or layer, it can be directly on, connected or coupled to the other element or layer or intervening elements or layers may be present. Like numbers may refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure.

Spatially relative terms, such as "beneath", "below", "lower", "above", "upper", etc., may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Hereinafter, embodiments of the present disclosure will be explained in detail with reference to the accompanying drawings.

Figure 1:
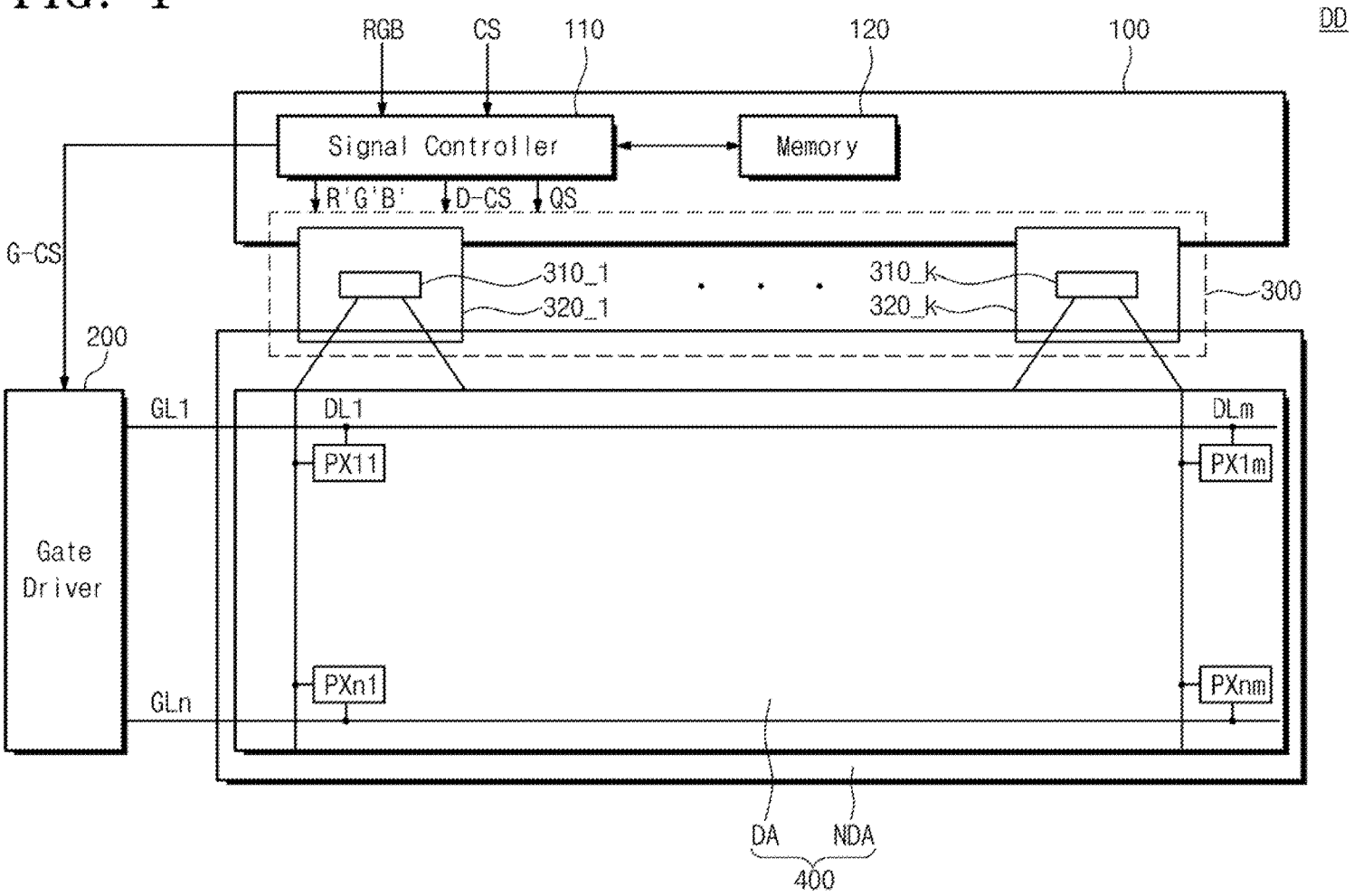
FIG. 1 is a block diagram showing a display device according to an exemplary embodiment of the present disclosure.

FIG. 1 is a block diagram showing a display device DD according to an exemplary embodiment of the present disclosure.

Referring to FIG. 1, the display device DD includes a driving circuit board 100, a gate driver 200, a data driver 300, and a display panel 400.

The driving circuit board 100 includes a signal controller 110 to control an overall operation of the display device DD. The signal controller 110 receives a plurality of image signals RGB and a plurality of control signals CS from the outside of the display device DD. The signal controller 110 converts a data format of the image signals RGB to a data format appropriate to an interface between the data driver 300 and the signal controller 110. Image signals R'G'B' having the converted data format are applied to the data driver 300.

The signal controller 110 outputs a plurality of driving signals in response to the control signals CS. For example, the signal controller 110 generates a data control signal D-CS and a gate control signal G-CS as the driving signals. The data control signal D-CS may include an output start signal, a horizontal start signal, and a reset signal. The gate control signal G-CS may include a vertical start signal and a vertical clock bar signal. The signal controller 110 applies the data control signal D-CS to the data driver 300 and applies the gate control signal G-CS to the gate driver 200. In an exemplary embodiment, the signal controller 110 applies the gate control signal G-CS to the gate driver 200 through one flexible circuit board 320_*k* from among flexible circuit boards included in the data driver 300.

An inter-symbol interference may occur in the image signals R'G'B', or noises may be included in the image signals R'G'B' when the image signals R'G'B' output from the signal controller 110 are applied to a plurality of data driving circuits 310_1 to 310_*k*. As a result, a signal quality of the image signals R'G'B' is deteriorated. In addition, the image signals R'G'B' may not be recognized by the data driving circuits 310_1 to 310_*k* due to the noises According to an exemplary embodiment, the display device DD automatically performs an eye tuning operation to secure an eye diagram reference margin. As a result, the noises may be prevented from being included in the image signals R'G'B'. The term "eye diagram" used herein means an overlapped voltage waveform of an optical signal or an electrical signal. The waveform of the eye diagram may be changed depending on the noises included in the electrical signal.

For example, in an exemplary embodiment the signal controller 110 performs the eye tuning operation to secure the eye diagram reference margin of the image signals R'G'B' at the beginning of the operation of the display device DD. The eye diagram reference margin may be a reference value to allow the image signals R'G'B' to be recognized by the data driving circuits 310_1 to **310_*k***.

The signal controller 110 applies a plurality of eye tuning signals QS to the data driving circuits 310_1 to **310_*k* included in the data driver 300**, respectively.

The gate driver 200 generates a plurality of gate signals in response to the gate control signal G-CS provided from the signal controller 110. The gate signals are sequentially applied to a plurality of pixels PX11 to PXnm by row through a plurality of gate lines GL1 to GLn. Therefore, the pixels PX11 to PXnm are driven by row.

The data driver 300 receives the image signals R'G'B' and the data control signal D-CS from the signal controller 110. The data driver 300 generates a plurality of data voltages respectively corresponding to the image signals R'G'B' in response to the data control signal D-CS. The data driver 300 applies the data voltages to the pixels PX11 to PXnm through the data lines DL1 to DLm. Herein, n, m and k are integers greater than or equal to one.

In an exemplary embodiment, the data driver 300 includes the data driving circuits 310_1 to **310_*k*, and 'k' is an integer greater than 0 and smaller than 'm'. The data driving circuits 310_1 to 310_*k* are respectively mounted on a plurality of flexible circuit boards 320_1 to 320_*k*. The flexible circuit boards 320_1 to 320_*k* are connected to the driving circuit board 100** and a non-display area NDA disposed adjacent to an upper portion of a display area DA.

In an exemplary embodiment, the data driving circuits 310_1 to **310_*k* are mounted on the flexible circuit boards 320_1 to 320_*k* in a tape carrier package (TCP) scheme. However, exemplary embodiments are not limited thereto. For example, the data driving circuits 310_1 to 310_*k* may be mounted on the flexible circuit boards 320_1 to 320_*k*** in a chip on glass (COG) scheme.

The display panel 400 includes the display area DA in which an image is displayed and the non-display area NDA disposed around the display area DA. In an exemplary embodiment, the non-display area NDA surrounds the display area DA.

The display panel 400 includes the pixels PX11 to PXnm arranged in the display area DA. The display panel 400 includes the gate lines GL1 to GLn and the data lines DL1 to DLm. The data lines DL1 to DLm are insulated from the gate lines GL1 to GLn and cross the gate lines GL1 to GLn.

The gate lines GL1 to GLn are connected to the gate driver 200 and sequentially receive the gate signals. The data lines DL1 to DLm are connected to the data driver 300 and receive the data voltages.

The pixels PX11 to PXnm are disposed in areas defined in association with the gate lines GL1 to GLn and the data lines DL1 to DLm. Accordingly, the pixels PX11 to PXnm are arranged in n rows by m columns.

Each of the pixels PX11 to PXnm is connected to a corresponding gate line of the gate lines GL1 to GLn and a corresponding data line of the data lines DL1 to DLm. The pixels PX11 to PXnm receive the data voltages through the data lines DL1 to DLm in response to the gate signals provided through the gate lines GL1 to GLn. As a result, the pixels PX11 to PXnm display grayscales corresponding to the data voltages.

Figure 2:
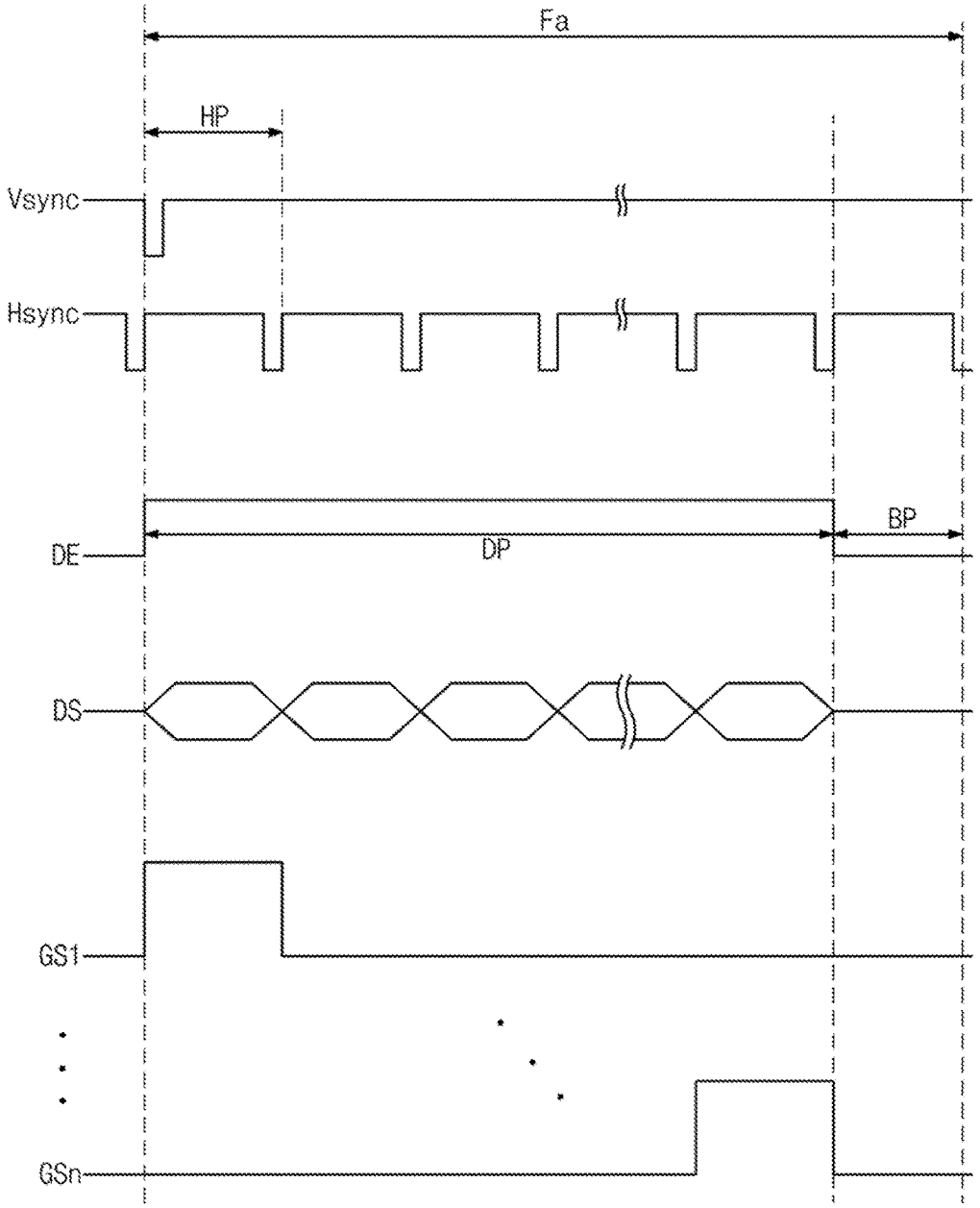
FIG. 2 is a timing diagram showing operations of gate and data drivers shown in FIG. 1 according to an exemplary embodiment of the present disclosure.

FIG. 2 is a timing diagram showing operations of the gate and data drivers 200 and 300 shown in FIG. 1, according to an exemplary embodiment of the present disclosure.

Referring to FIGS. 1 and 2, the signal controller 110 may output the driving signals. For example, in an exemplary embodiment the signal controller 110 applies the vertical start signal Vsync to distinguish a frame period Fa to the gate driver 200. The frame period Fa means a period in which one image is displayed.

For example, in an exemplary embodiment the signal controller 110 applies a horizontal synchronization signal as a frame distinction signal to distinguish horizontal periods HP and a data enable signal DE maintained at a high level during a period, in which data is output, to indicate a data input period to the data driver 300.

In an exemplary embodiment, the vertical synchronization signal Vsync is included in the gate control signal G-CS, and the horizontal synchronization signal Hsync and the data enable signal DE are included in the data control signal D-CS. The gate control signal G-CS may include a clock signal and a clock bar signal to generate the gate signals GS1 to GSn with a high level.

In an exemplary embodiment, the data voltages DS output from the data driver 300 include positive polarity data voltages having a positive value with respect to a common voltage and/or negative polarity data voltages having a negative value with respect to the common voltage. During each horizontal period HP, a portion of the data voltages DS applied to the data lines DL1 to DLm has the positive polarity and the other portion of the data voltages DS applied to the data lines DL1 to DLm has the negative polarity. The polarity of the data voltages DS may be inverted in accordance with the frame period Fa to prevent liquid crystals from burning or deteriorating. The data driver 300 generates the data voltages DS inverted every frame period in response to an inversion signal.

In an exemplary embodiment, the gate driver 200 generates the gate signals GS1 to GSn during the frame period Fa in response to the gate control signal G-CS provided from the signal controller 110. The gate driver 200 applies the gate signals GS1 to GSn to the gate lines GL1 to GLn. The gate signals GS1 to GSn are sequentially output to correspond to the horizontal periods HP.

In an exemplary embodiment, the display panel 400 displays the image on the basis of the corresponding frame during a display period DP and does not display the image during a blank period BP. The display period DP in which the image is displayed corresponds to a period in which the data voltages DS are applied to the data lines DL1 to DLm, and the data enable signal DE is maintained at a high level. The blank period BP corresponds to a period in which the data voltages DS are not applied to the data lines DL1 to DLm, and the data enable signal DE is maintained at a low level.

Figure 3:
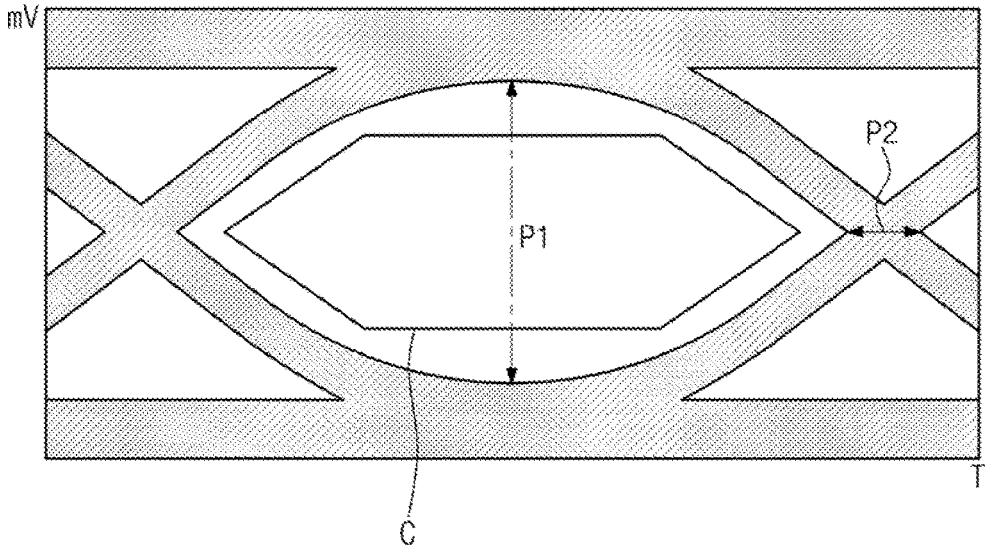
FIG. 3 is an eye diagram showing an image signal provided from the data driver shown in FIG. 1 according to an exemplary embodiment of the present disclosure.

FIG. 3 is an eye diagram showing the image signal provided from the data driver 300 shown in FIG. 1 according to an exemplary embodiment of the present invention. In FIG. 3, the x-axis indicates a time T and the y-axis indicates a voltage level mV.

Referring to FIGS. 1 and 3, a hexagonal shape shown in FIG. 3 may be the eye diagram reference margin C, which allows the image signals R'G'B' to be recognized by the data driving circuits 310_1 to **310_*k*. For example, when the image signals R'G'B' have the eye diagram reference margin C, the data driving circuits 310_1 to 310_*k*** may be driven by the image signals R'G'B'.

When the signal waveform corresponding to an eye shape shown in FIG. 3 does not infiltrate the eye diagram reference margin C having the hexagonal shape, the data driving circuits 310_1 to **310_*k*** may recognize the image signals R'G'B'.

The signal quality of the image signals R'G'B' may be deteriorated by various noise components such as, for example, jitter components, inter-symbol interference, etc., while the image signals R'G'B' output from the signal controller 110 are applied to the data driving circuits 310_1 to **310_*k*. In this case, the electrical signal waveform having the eye shape infiltrates the eye diagram reference margin C. As a result, the image signals R'G'B' may not be recognized by the data driving circuits 310_1 to 310_*k***.

The graph corresponding to the eye shape shown in FIG. 3 may be deformed in accordance with a first width P1 and a second width P2. The deformation of the first width P1 is changed in accordance with a first condition and the deformation of the second width P2 is changed in accordance with a second condition. The first condition is employed to control the jitter components in which a frequency is deformed from an ideal pulse and the second condition is employed to control a noise margin included in the image signals R'G'B'.

According to an exemplary embodiment, the eye diagram reference margin C is changed in accordance with the first and second conditions. However, exemplary embodiments are not limited thereto. For example, the signal controller 110 may deform the eye diagram reference margin C according to various conditions.

The signal controller 110 generates a plurality of eye tuning signals using the first and second conditions. Each of the eye tuning signals is generated by different first and second conditions. The signal controller 110 applies the image signals R'G'B' to the data driving circuits 310_1 to **310_*k*** on the basis of an eye tuning signal having optimal first and second conditions among the eye tuning signals.

Figure 4:
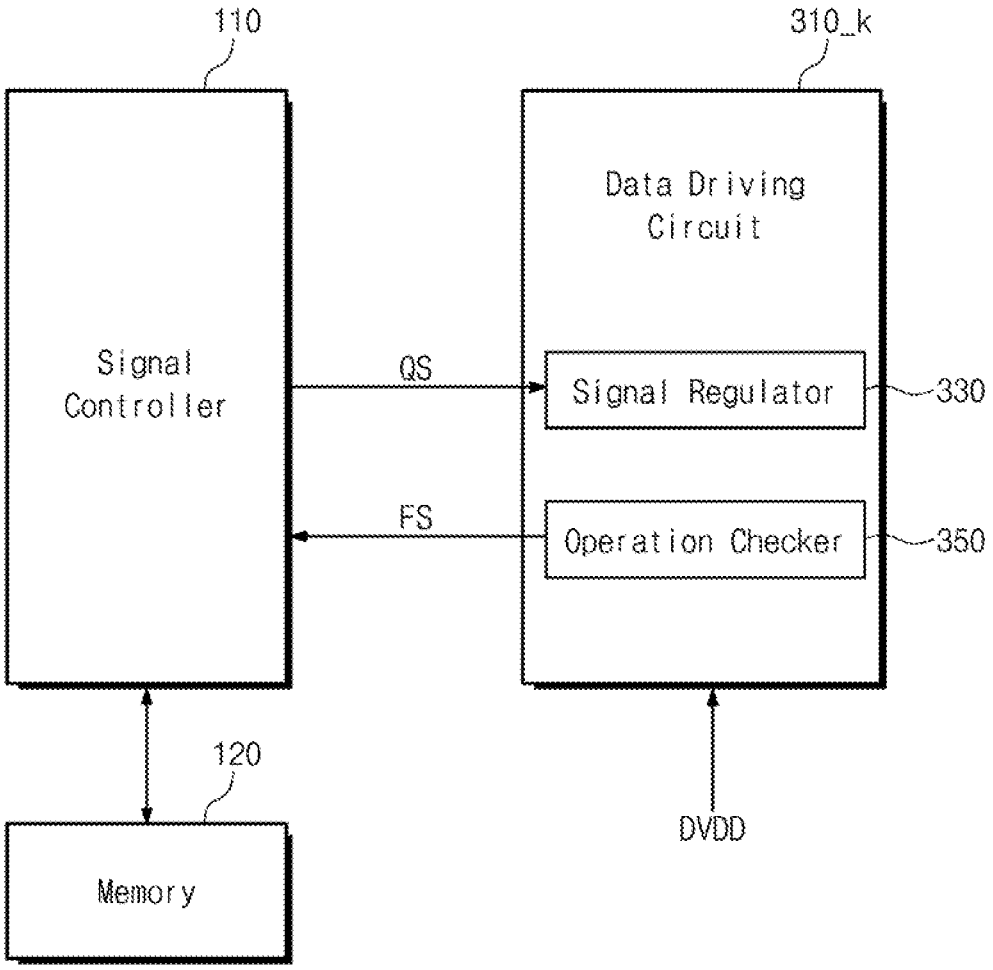
FIG. 4 is a block diagram showing a signal transmission between a signal controller and a data driver according to an exemplary embodiment of the present disclosure.

FIG. 4 is a block diagram showing a signal transmission between the signal controller 110 and the data driver 300 according to an exemplary embodiment of the present disclosure.

Referring to FIG. 4, the signal controller 110 performs the eye tuning operation to secure the eye diagram reference margin at the beginning of the operation of the display device DD. For example, the signal controller 110 may generate the eye tuning signals QS using the first and second conditions shown in FIG. 3. Each of the data driving circuits 310_1 to **310_*k* outputs the image signals R'G'B' on the basis of one eye tuning signal of the eye tuning signals. Hereinafter, one data driving circuit 310_*k*** outputting the image signals R'G'B' on the basis of the one eye tuning signal from among the eye tuning signals QS will be described as a representative example.

The data driving circuit **310_*k* includes a signal regulator 330 and an operation checker 350. The signal regulator 330 receives the eye tuning signals QS from the signal controller 110**.

According to an exemplary embodiment, the signal regulator 330 changes the signal quality of the eye tuning signals QS to determine an optimal eye tuning signal condition.

For example, in an exemplary embodiment, the signal regulator 330 controls a signal-to-noise ratio (SNR) of the eye tuning signals QS. For example, the signal regulator 330 may generate a plurality of noise signals obtained by changing the SNR of the eye tuning signals QS. In an exemplary embodiment, the SNR of the noise signals may be higher than that of the eye tuning signals QS. For example, the noise signals may include more noises and the inter-symbol interference than the eye tuning signals QS.

As a result, the reference margin of the eye diagram of the noise signals, which is utilize for normal operation, may be worse than the eye diagram of the eye tuning signals QS. As described above, the noise signal among the noise signals, which is recognizable by the data driving circuit **310_*k***, may obtain a greater eye diagram margin than that of the eye tuning signal QS in which the signal quality is not changed.

The operation checker 350 checks whether the data driving circuit **310_*k* is operated or not in response to each noise signal. The operation checker 350 applies checking information FS to the signal controller 110** in response to the noise signals.

The signal controller 110 selects the optimal eye tuning signal from among the eye tuning signals QS used to operate the data driving circuit **310_*k* on the basis of the checking information FS. The signal controller 110 stores condition information of the selected eye tuning signal in a memory 120. The signal controller 110 outputs the image signals R'G'B' to the data driving circuit 310_*k* on the basis of the condition information of the eye tuning signal stored in the memory 120**.

The memory 120 may be, but is not limited to, a non-volatile memory. For example, the memory 120 may be a flash memory, a magnetic RAM (MRAM), a spin-transfer torque MRAM, a conductive bridging RAM (CBRAM), a ferroelectric RAM (FeRAM), a phase RAM (PRAM) such as an ovonic unified memory (OUM), a resistive RAM (RRAM or Re-RAM), a nanotube RAM, a polymer RAM (PoRAM), a nano floating gate memory (NFGM), a holographic memory, a molecular electronics memory, or an insulator resistance change memory.

Figure 5:
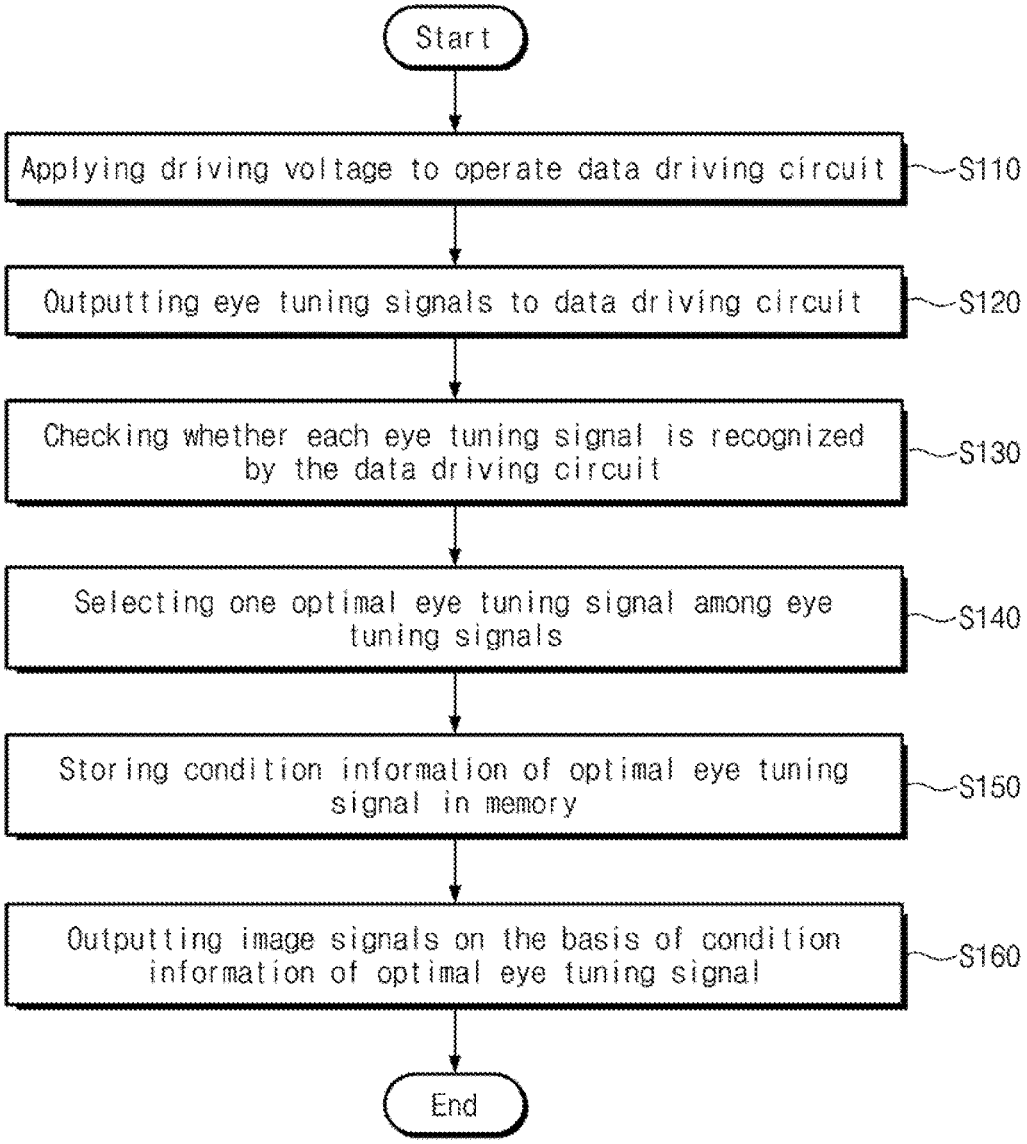
FIG. 5 is a flowchart showing an eye tuning operation of a signal controller according to an exemplary embodiment of the present disclosure.

FIG. 5 is a flowchart showing the eye tuning operation of the signal controller 110 according to an exemplary embodiment of the present disclosure.

Referring to FIGS. 4 and 5, in an exemplary embodiment, the signal controller 110 applies a driving voltage DVDD to the data driving circuit **310_*k* to operate the data driving circuit 310_*k* (S110**).

The signal controller 110 sequentially outputs the eye tuning signals QS to the data driving circuit **310_*k* (S120**).

The signal controller 110 determines whether each of the eye tuning signals QS is recognized by the data driving circuit **310_*k* (S130). For example, the signal controller 110 determines whether the data driving circuit 310_*k* is operated in response to each of the eye tuning signals QS. The signal controller 110** may control the SNR of the eye tuning signals QS.

The signal controller 110 selects the optimal eye tuning signal from the eye tuning signals on the basis of the checking information FS obtained by checking whether the data driving circuit **310_*k* is operating (S140**).

The signal controller 110 stores the condition information of the selected optimal eye tuning signal in the memory 120 (S150). In this case, the signal controller 110 may store the condition information of the optimal eye tuning signal of each of the data driving circuits 310_1 to **310_*k***.

The signal controller 110 outputs the image signals on the basis of the condition information of the eye tuning signal corresponding to the data driving circuit **310_*k*, which is stored in the memory 120 (S160**).

FIGS. 6 and 7 are tables showing results of the eye tuning operation according to an exemplary embodiment of the present disclosure.

The table shown in FIG. 6 includes first to eighth eye tuning signals QS1 to QS8, the first condition I1, the second condition I2, and first to third checking information. Hereinafter, the table shown in FIG. 6 will be described on the basis of the operations of three data driving circuits from among the data driving circuits 310_1 to 310_*k*. Each of the first to third data driving circuits sequentially receives the first to eighth eye tuning signals QS1 to QS8.

In addition, the table shown in FIG. 6 shows first to third checking information, each including the checking result obtained by checking whether the first to eighth eye tuning signals QS1 to QS8 are recognized by each of the first to third data driving circuit 310_1 to 310_*k*. As described above, first to eighth noise signals obtained by controlling the SNR of the first to eighth eye tuning signals QS1 to QS8 are included in the first to third checking information to indicate whether the first to eight noise signals are recognized by each of the first to third data driving circuits 310_1 to 310_*k*.

Referring to FIGS. 4, 6, and 7, the signal controller 110 outputs the first to eighth eye tuning signals QS1 to QS8 to the data driving circuit 310_*k*. In this case, the first to eighth eye tuning signals QS1 to QS8 have different first and second conditions I1 and I2.

According to the present exemplary embodiment, the first to eighth eye tuning signals QS1 to QS8 are classified by the first and second conditions I1 and I2, but they should not be limited thereto. For example, each of the first to eighth eye tuning signals, QS1 to QS8, may be different from each other depending on the conditions. The eye shape of the eye diagram may be deformed by the conditions.

As represented by the first checking information, the fourth to sixth consecutive eye tuning signals QS4 to QS6 are determined by the first data driving circuit to be in an ON state. As represented by the second checking information, the second to fourth consecutive eye tuning signals QS2 to QS4 are determined by the second data driving circuit to be in an ON state. As represented by the third checking information, the fifth to seventh consecutive eye tuning signals QS5 to QS7 are determined by the third data driving circuit to be in an ON state.

It is to be understood that according to exemplary embodiments of the present disclosure, the selected optimal eye tuning signal may correspond to the selected eye tuning signal having an intermediate value, as described further herein.

Referring to FIG. 7, the signal controller 110 selects the condition information of the fifth eye tuning signal QS5 having an intermediate value among the fourth to sixth eye tuning signals QS4 to QS6 based on the first checking information indicating the ON state. The signal controller 110 stores the condition information of the fifth eye tuning signal QS5 in the memory 120. Then, the signal controller 110 applies the image signals to the first data driving circuit in response to the condition information of the fifth eye tuning signal QS5.

The signal controller 110 selects the condition information of the third eye tuning signal QS3 having an intermediate value among the second to fourth eye tuning signals QS2 to QS4 based on the second checking information indicating the ON state. The signal controller 110 stores the condition information of the third eye tuning signal QS3 in the memory 120. Then, the signal controller 110 applies the image signals to the second data driving circuit in response to the condition information of the third eye tuning signal QS3.

The signal controller 110 selects the condition information of the sixth eye tuning signal QS6 having an intermediate value among the fifth to seventh eye tuning signals QS5 to QS7 based on the third checking information indicating the ON state. The signal controller 110 stores the condition information of the sixth eye tuning signal QS6 in the memory 120. Then, the signal controller 110 applies the image signals to the third data driving circuit in response to the condition information of the sixth eye tuning signal QS6.

According to exemplary embodiments, when there are at least three consecutive eye tuning signals in an ON state, and when the number of consecutive eye tuning signals in the ON state is odd, the eye tuning signal having the intermediate value from among the consecutive odd-number eye tuning signals may be selected as the optimal eye tuning signal. For example, when there are five consecutive eye tuning signals in an ON state, the third eye tuning signal from among the five consecutive eye tuning signals may be selected as the optimal eye tuning signal.

According to the present exemplary embodiment, the signal controller 110 selects the eye tuning signal having an intermediate value among an odd-number of eye tuning signals the corresponding data driving circuit determines to be in an ON state. In this case, the odd-numbered eye tuning signals are configured to include at least three eye tuning signals that are consecutive.

According to the present exemplary embodiment, the signal controller 110 may select one of two eye tuning signals closest to the intermediate value among even-numbered eye tuning signals the corresponding data driving circuit determines to be in an ON state. In this case, the even-numbered eye tuning signals are configured to include at least two eye tuning signals that are consecutive.

According to exemplary embodiments, when there are at least two consecutive eye tuning signals in an ON state, and when the number of consecutive eye tuning signals in the ON state is even, one of the two eye tuning signals having the intermediate value from among the consecutive even-number eye tuning signals may be selected as the optimal eye tuning signal. For example, when there are six consecutive eye tuning signals in an ON state, the third or fourth eye tuning signal from among the six consecutive eye tuning signals may be selected as the optimal eye tuning signal.

As described above, the display device DD automatically performs the eye tuning operation to secure the optimal eye diagram at the beginning of the operation of the display device DD. For example, in an exemplary embodiment, the display device DD controls the image signals on the basis of the condition information of the optimal eye tuning signal corresponding to each data driving circuit, which are stored in the memory 120, to allow the image signals to be recognized by each data driving circuit. As a result, a driving reliability of the display device DD may be improved.

Although the exemplary embodiments of the present disclosure have been described, it is understood that the present disclosure should not be limited to these exemplary embodiments but various changes and modifications can be made by one ordinary skilled in the art within the spirit and scope of the present disclosure as hereinafter claimed.

What is claimed is:

1. A method of driving a display device, comprising:

outputting sequentially a plurality of eye tuning signals;

receiving a plurality of checking information obtained from a data driving circuit, wherein the checking information indicates whether the data driving circuit is operating in an ON state in response to each of the plurality of eye tuning signals; and selecting one optimal eye tuning signal from among the plurality of eye tuning signals operating the data driving circuit based on the checking information, wherein a plurality of image signals is output based on a condition information of the optimal eye tuning signal, wherein selecting the one optimal eye tuning signal comprises (i) selecting one eye tuning signal having an intermediate value among three or more odd-number eye tuning signals that are consecutive, or (ii) selecting one eye tuning signal of first and second eye tuning signals closest to an intermediate value among two or more even-number eye tuning signals that are consecutive.

2. The method of claim 1, wherein each of the eye tuning signals is set by at least one different condition.

3. The method of claim 1, further comprising changing a signal-to-noise ratio of the eye tuning signals, wherein the operation of the data driving circuit is checked in response to each of the eye tuning signals in which the signal-to-noise ratio is changed.

4. The method of claim 1, wherein the data driving circuit is provided in a plural number and each of the data driving circuits outputs the image signals based on the condition information of the optimal eye tuning signal among the eye tuning signals.

5. The method of claim 4, further comprising storing the condition information of the optimal eye tuning signal corresponding to each of the data driving circuits in a memory.

6. A display device comprising:

a data driving circuit that generates a plurality of checking information by determining whether the data driving circuit is operating in response to each of a plurality of eye tuning signals, and that transmits the plurality of checking information to a signal controller; and the signal controller that sequentially outputs the plurality of eye tuning signals and receives the plurality of checking information, wherein the signal controller selects one optimal eye tuning signal among the plurality of eye tuning signals operating the data driving circuit based on the checking information and outputs a plurality of image signals to the data driving circuit based on the condition information of the optimal eye tuning signal, wherein the data driving circuit controls a signal-to-noise ratio of the eye tuning signals to generate a plurality of noise signals.

7. The display device of claim 6, wherein a signal-to-noise ratio of the noise signals is smaller than the signal-to-noise ratio of the eye tuning signals.

8. The display device of claim 6, wherein the data driving circuit comprises an operation checker that checks whether the data driving circuit is operated in response to each of the noise signals, and the operation checker applies the checking information obtained by checking whether the data driving circuit is operated in response to each of the noise signals to the signal controller.

9. The display device of claim 6, wherein each of the eye tuning signals is differentiated by at least one condition.

10. The display device of claim 6, wherein the data driving circuit comprises a plurality of data driving circuits and the signal controller outputs the image signals to each of the data driving circuits based on the condition information of the optimal eye tuning signal for each data driving circuit.

11. The display device of claim 6, further comprising a memory storing the condition information of the optimal eye tuning signal.

12. The display device of claim 11, wherein the memory is nonvolatile memory.

13. A method of driving a display device, comprising:

receiving a plurality of eye tuning signals;

modifying the plurality of eye tuning signals;

checking whether a data driving circuit is operating in response to each of the plurality of eye tuning signals and generating a checking information based on the checking;

transmitting the checking information to a signal controller;

selecting an eye tuning signal from among the plurality of eye tuning signals;

receiving a plurality of image signals based on condition information of the selected eye tuning signal;

wherein the selected eye tuning signal is selected based on the checking information, wherein selecting the eye tuning signal comprises (i) selecting one eye tuning signal having an intermediate value among three or more odd-number eye tuning signals that are consecutive, or (ii) selecting one eye tuning signal of first and second eye tuning signals closest to an intermediate value among two or more even-number eye tuning signals that are consecutive.

14. The method of claim 13, further comprising changing a signal-to-noise ratio of the eye tuning signals to improve the signal quality.

15. The method of claim 13, wherein checking whether a data driving circuit is operating in response to each of the plurality of eye tuning signals includes determining if the data driving circuit is operating in response to each eye tuning signal of the plurality of eye tuning signals received.

* * * * *